US006371159B1

(12) United States Patent
Timberlake

(10) Patent No.: US 6,371,159 B1
(45) Date of Patent: Apr. 16, 2002

(54) FUEL TRANSFER SYSTEM

(76) Inventor: Robert L. Timberlake, 5401 Westhaven Dr., Evansville, IN (US) 47720

( * ) Notice: Subject to any disclaimer, the term of this patent is extended or adjusted under 35 U.S.C. 154(b) by 0 days.

(21) Appl. No.: 08/949,194

(22) Filed: Oct. 14, 1997

Related U.S. Application Data

(60) Provisional application No. 60/029,125, filed on Oct. 16, 1996.

(51) Int. Cl.[7] ..... F17D 1/14; B67D 5/04

(52) U.S. Cl. ..... 137/572; 137/899; 137/565.33; 141/388

(58) Field of Search ..... 137/572, 571, 137/142, 150, 351, 147, 565.29, 565.33, 899; 141/388

(56) References Cited

U.S. PATENT DOCUMENTS

| | | | | | |
|---|---|---|---|---|---|
| 1,573,291 | A | * | 2/1926 | Bianchi | 137/150 |
| 3,170,495 | A | * | 2/1965 | Wagner | 137/572 X |
| 3,272,241 | A | * | 9/1966 | Wagner | 141/388 |
| 3,409,040 | A | * | 11/1968 | Weston et al. | 137/572 |
| 4,064,901 | A | * | 12/1977 | Bailey | 137/351 |
| 5,038,741 | A | * | 8/1991 | Tuckey | 123/509 |
| 5,234,016 | A | * | 8/1993 | Winn | 137/142 |
| 5,333,639 | A | * | 8/1994 | Nelson | 137/150 |
| 5,718,260 | A | * | 2/1998 | Leonardi | 137/572 X |

* cited by examiner

*Primary Examiner*—John Rivell

(57) ABSTRACT

A fuel transfer system for transferring fuel from the fuel tank in a boat to auxiliary equipment such as water ski. The fuel transfer system includes a fuel pump, a fuel dispenser that can be attached and removed by means of quick disconnect couplings, and an optional shutoff valve.

4 Claims, 2 Drawing Sheets

FUEL TRANSFER SYSTEM

CROSS REFERENCES TO THE RELATED APPLICATIONS

This application claims priority to provisional application Ser. No. 60/029,125 filed Oct. 16, 1996.

STATEMENT AS TO RIGHTS TO INVENTIONS MADE UNDER FEDERALLY SPONSORED RESEARCH AND DEVELOPMENT

Not applicable

BACKGROUND OF THE INVENTION

1. Field of the Invention

The present invention is an improved means of transferring fuel for auxiliary purposes for boat, yacht and ship operators.

2. Background Information

When boaters fuel auxiliary equipment such as powered water skis, they typically lug five gallon cans of gasoline from a shore based fuel pump to their boat, storing the cans at the rear of their boat. Then, kneeling or crouching on the rear lower deck of their boat, they pour fuel from the five gallon cans into a fuel tank of the auxiliary equipment. This is awkward, physically taxing, risks injury, and includes the probability of spilling fuel into the water. During this fueling of the auxiliary equipment, both the boat auxiliary equipment are typically dead in the water, bobbing independently with the waves. When the boater goes out for a week-end cruise or longer, often multiple five gallon cans of gasoline are stored in the rear of the boat, on the deck, or on the hull. This is not a safe practice.

As an avid boater, I came up with my invention to avoid lugging five gallon cans, storing multiple cans of gasoline on my rear deck in an unsafe manner, and spilling the fuel into the water while trying to pour the fuel into the fuel tank of a water ski. After crouching on a platform at the rear of a boat gently bobbing in the water while trying to pour gasoline into a fuel tank of a water ski bobbing independently of the boat in the water, and experiencing the frustration of spilling gasoline into the water, and risking injury manhandling a five gallon can of fuel in such an awkward circumstance, I figured there had to be a better way. As I could not find anything on the market, I came with my invention. I have not seen anything like the present invention and believe it is unique.

As will be seen in the subsequent description, the present invention overcomes the disadvantages of the above described approach to fueling auxiliary equipment.

SUMMARY

The present invention is a means of transferring fuel from a boat fuel tank to auxiliary apparatus in a safe and efficient manner. It includes a fuel dispensing arrangement and a fuel transfer pump connected to a boat's fuel tank.

BRIEF DESCRIPTION OF THE DRAWINGS

FIG. 6 shows the present invention as typically used.

FIG. 7 shows the current method, prior to the present invention.

DESCRIPTION OF THE PREFERRED EMBODIMENTS

Figures 1, 2, 3:
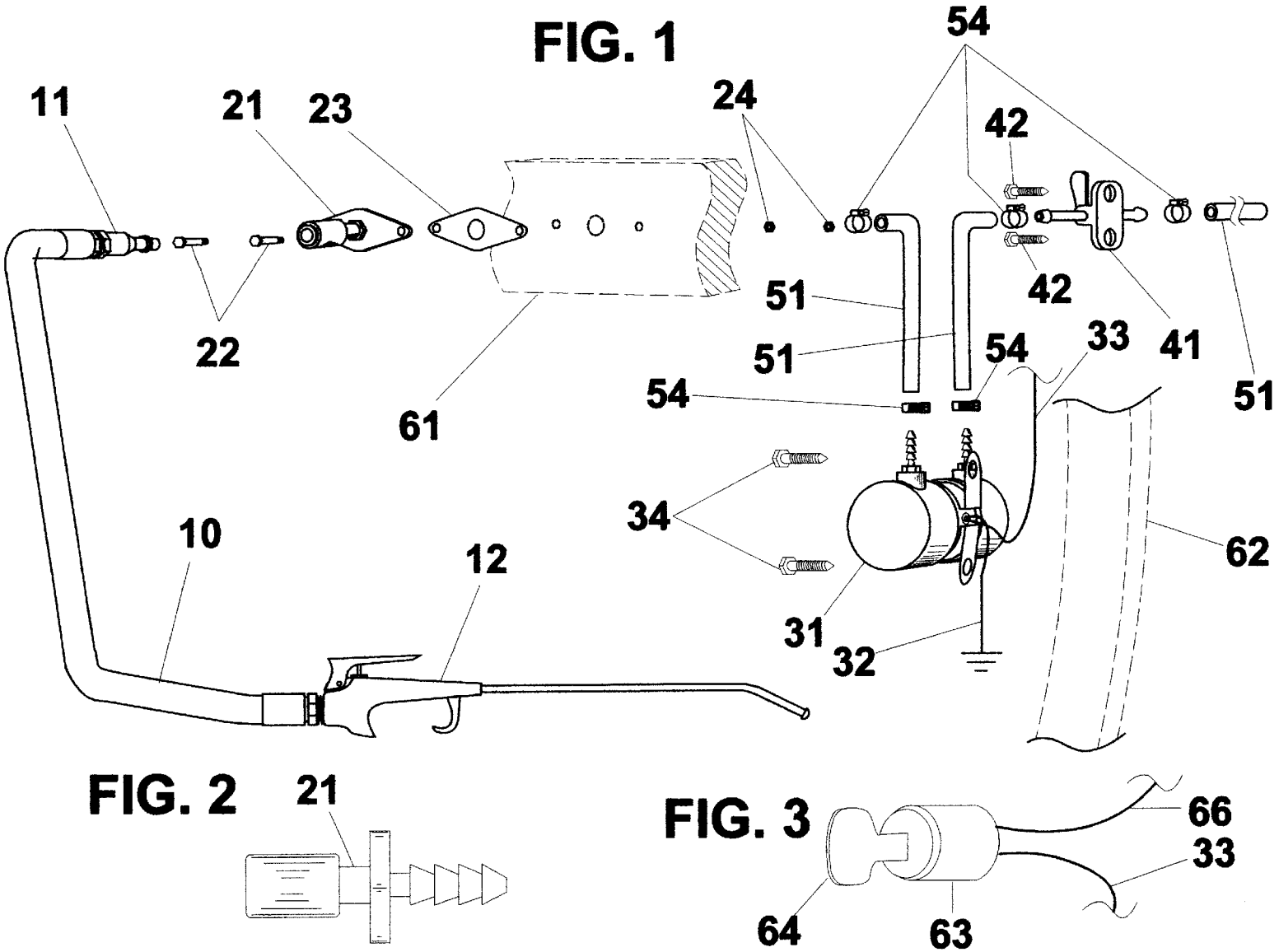
FIG. 1 shows an exploded view of the present invention.
FIG. 2 shows a detail from FIG. 1.
FIG. 3 shows an ignition switch such as might be used with the present invention.
Figure 4:
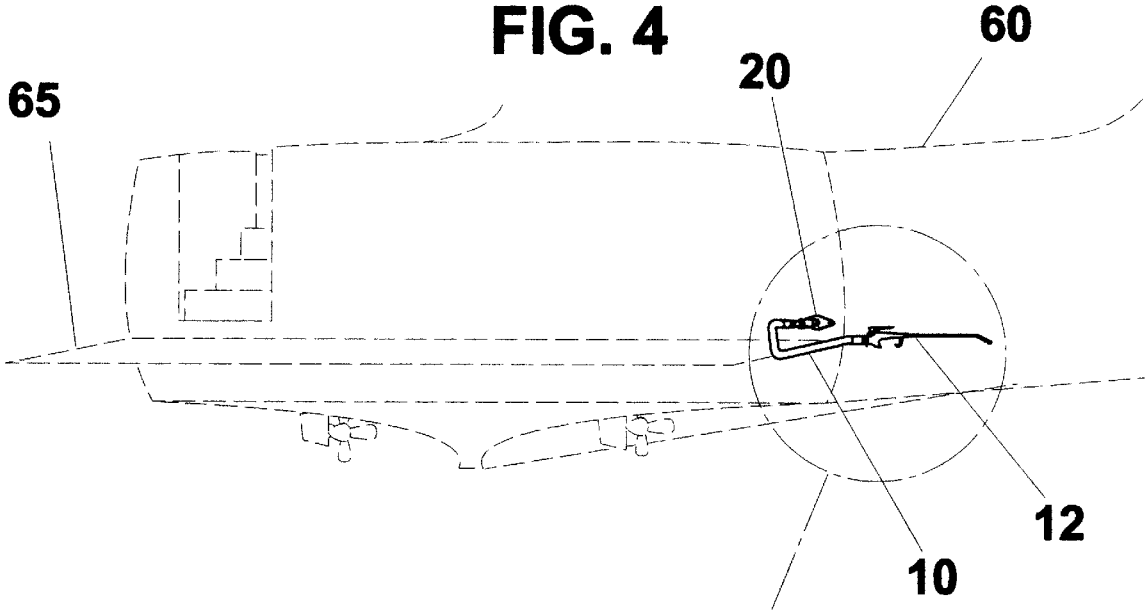
FIG. 4 shows the present invention in a typical installation.
Figure 5:
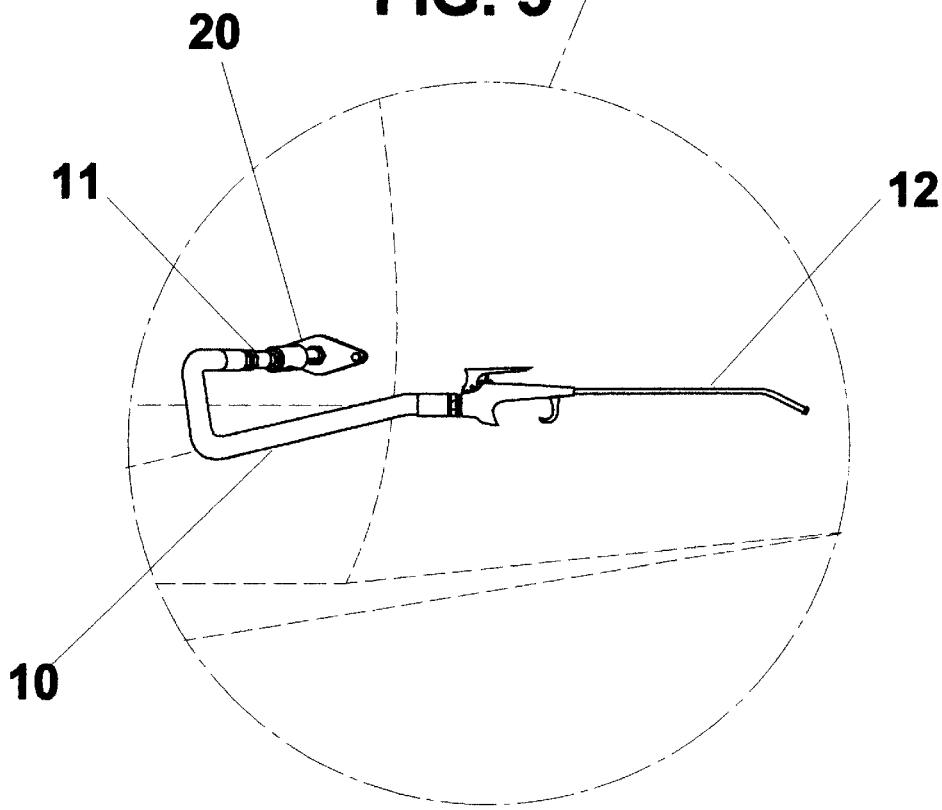
FIG. 5 shows an enlargement of the present invention from FIG. 4.

Referring to FIGS. 1, 2, 3, 4, and 5, the preferred embodiment of the present invention, a fuel transfer system, includes a removable fuel dispenser 10, bolts 22, a quick connect subassembly 21, a gasket 23, nuts 24, fuel lines 51, clamps 54, fuel pump 31, negative power lead 32, positive power lead 33, fuel pump mount screws, 34, fuel shutoff valve 41, shutoff valve mount screw 2, and fuel lines 51. A boat transom section 61 and a boat side frame 62 are not part of the invention. As can be seen in FIG. 1, the removable fuel dispenser 10 includes a quick connect coupler male end 11 and a hand valve nozzle assembly 12, in the preferred embodiment of the present invention. The quick connect female assembly 21 is attached to the boat transom section 61 by means of the bolts 22 that go through the boat transom section 61 and are secured to the boat transom section 61 by means of the nuts 24. Normally, the gasket 23 would be sandwiched between the quick connect female assembly 21 and the boat transom section 61. One of fuel lines 51 connects the quick connect female assembly 21 to the fuel pump 31. A fuel line 51 also connects the fuel pump 31 to the fuel shutoff valve 41, said fuel shutoff valve 41 being connected to a fuel line 51 from a fuel tank used to supply a boat engine. The fuel lines 51 are secured by the clamps 54 as required to the fuel shutoff valve 41, the fuel pump 31, and the quick connect female assembly 21. Typically the fuel shutoff valve 41 is secured in position to the boat side frame 62 by the shutoff valve screws 42.

The positive power lead 33 would typically be connected to an electrical switch 63 located at some convenient location. The electrical switch 63 would also be connected to a power lead 66 from the boat. In the preferred embodiment of the present invention, the electrical switch 63 has a key 64. The negative power lead 32 is connected to ground.

When the present invention is not in use, the removable fuel dispenser 10 would be stowed on the boat. When it is desired to refuel auxiliary equipment, such as a powered water ski 71, as shown in FIG. 6, the removable fuel dispenser 10 is connected to the quick connect female assembly 21, which is mounted to the boat transom section 61. If the fuel shutoff valve 41, which is an option, is used, it is opened. Then, the fuel pump 31, which is electrically powered in the preferred embodiment of the present invention, is turned on. Then the desired amount of fuel is transferred by manually actuating the hand valve nozzle assembly 12. The fuel pump 31, in the preferred embodiment of the invention, as is typically used with engines in boats, has an internal diaphragm that closes an internal electrical switch which starts the pumping action when the hand valve nozzle assembly 12 is actuated. When the hand valve assembly 12 is no longer actuated, the fuel pump 31 automatically stops pumping as the diaphragm senses a pressure buildup in the removable fuel dispenser 10. This is how marine fuel pumps typically work. Upon completion of the fuel transfer, electrical power can be turned off at the electrical switch 63. The fuel shutoff valve 41, which is optional, is a convenience in the event the fuel pump 31 needs to be removed for repair or replacement. The removable fuel dispenser 10 would normally be disconnected from the quick connect female assembly 21 and then the removable fuel dispenser 10 returned to stowage.

Compare FIG. 6 to FIG. 7. In FIG. 7, the prior art consisted of pouring fuel from a fuel can 72, typically a five gallon fuel can, from a platform 65 at the rear of a boat 60 into a powered water ski 71 in the water alongside the boat 60. As a five gallon fuel can full of fuel weighs approximately 40 pounds, and as one pouring fuel must be on the platform 65 while both the boat 60 and the powered water ski 71 are apt to be bobbing in the waves, this entails a risk of spilling fuel or incurring injury. FIG. 6 shows how much easier and safer it is to dispense fuel from the present invention into the powered water ski 71 in the water alongside the boat 60 as compared to the prior art shown in FIG. 7.

While all this componentry described is commercially available, no one has tied them together to provide a safe and convenient way to fuel auxiliary apparatus such as recreational equipment such as powered water skis. While it can be argued that this is an obvious solution to the problem of safely and conveniently fueling and refueling auxiliary apparatus such as water recreational equipment, no one, to my knowledge has done this before, so it has not been obvious before I did it.

In the preferred embodiment of the invention, the fuel lines 51 are neopreme. The other materials of construction would either be a suitable plastic, or an appropriate metal such as stainless steel, or ordinary steel treated for corrosion resistance such as by plating or by galvanizing. The fuel pump 31 in the preferred embodiment of the present invention is a 12 volt DC electric driven, 1.8 gallons per minute, product of Federal Mogul Corporation of Detroit, Mich.

Although the description above contains many specificities, these should not be construed as limiting the scope of the invention but as merely providing illustrations of some of the presently preferred embodiments of this invention. For example, the fuel pump 31 could be four gallons per minute as opposed to 1.8 gallons per minute. Also, the male and female ends of the quick disconnect arrangement could be reversed. However, the present description is the preferred embodiment as the quick connect female assembly 21 as shown in FIG. 21 is normally closed until the quick connect couple male end 11 is connected. This reduces the chance of water getting in the fuel line when the fuel transfer system is in use.

Thus the scope of the invention should be determined by the appended claims and their legal equivalents, rather than by the examples given.

I claim:

1. A fuel transfer system for transferring the fuel from the tank of a first vehicle having a main fuel system to an auxiliary tank including:

an auxiliary fuel pump, said auxiliary fuel pump connected through a valve to said main fuel system, said auxiliary fuel pump operating independent from said main fuel system to transfer fluid even when said main fuel system not operating.

2. A fuel transfer system for transferring the fuel from the tank of a first vehicle having a main fuel system to an auxiliary tank including:

an auxiliary fuel pump, said auxiliary fuel pump connected through a valve to said main fuel system, said auxiliary fuel pump operating independent from said main fuel system to transfer fluid even when said main fuel system not operating;

wherein the secondary fuel pump is electric;

wherein the secondary fuel pump is turned on by a key switch;

wherein the secondary fuel pump is connected to the fuel tank by a line containing a shutoff valve.

3. The fuel transfer system of claim 2 wherein the fuel tank is on a boat and the line passes through the transom section of the boat.

4. The fuel transfer system of claim 3 wherein the fuel tank is on a boat and the line passes through the outer shell of the boat.

* * * * *